United States Patent [19]

Meisenburg

[11] Patent Number: 4,792,313

[45] Date of Patent: Dec. 20, 1988

[54] MARINE DRIVE LOWER GEARCASE WITH NON-CAVITATING DRAIN PLUG LOCATION

[75] Inventor: Gary L. Meisenburg, Fond du Lac, Wis.

[73] Assignee: Brunswick Corporation, Skokie, Ill.

[21] Appl. No.: 175,844

[22] Filed: Mar. 31, 1988

[51] Int. Cl.[4] ..... B63H 21/24

[52] U.S. Cl. ..... 440/76; 440/75; 440/88; 123/196 R

[58] Field of Search ..... 440/49, 50, 66, 78, 440/75, 88, 89, 113, 900; 123/196 R, 196 A, 196 CP, 196 W

[56] References Cited

U.S. PATENT DOCUMENTS

| | | | |
|---|---|---|---|
| 1,181,634 | 5/1916 | Bivert | 440/88 |
| 1,932,523 | 10/1933 | Irgens | 440/75 |
| 3,871,324 | 3/1975 | Snyder | 440/89 |
| 3,896,757 | 7/1975 | Kucher | 440/88 |
| 4,178,873 | 12/1979 | Bankstahl | 440/89 |

OTHER PUBLICATIONS

"MerCruiser 1987", Mercury Marine Part No. 90-113-04-87, 1986.

"MerCruiser Way OUt in Front, 1988,", Mercury Marine Part No. 90-11304-88, 1987.

*Primary Examiner*—Joseph F. Peters, Jr.
*Assistant Examiner*—Jesus D. Sotelo
*Attorney, Agent, or Firm*—Andrus, Sceales, Starke & Sawall

[57] ABSTRACT

A marine drive (2) having a lower gearcase (4) with a torpedo housing (10) having an internal lubricant-containing cavity (26) has a removable drain plug (50) and drain plug hole (52) at a location away from the exterior hydrodynamic surface (46) of the torpedo housing along which water flows, to prevent cavitation burns on the torpedo housing and the propeller (24), and to aid in eliminating propeller ventilation.

11 Claims, 1 Drawing Sheet

MARINE DRIVE LOWER GEARCASE WITH NON-CAVITATING DRAIN PLUG LOCATION

BACKGROUND AND SUMMARY

The invention relates to marine drive lower gearcases with a vertical drive shaft driving a horizontal propeller shaft in a torpedo housing and having a propeller mounted on the propeller shaft at the rear of the torpedo housing. The invention more particularly relates to an improved location for the drain plug which upon removal permits drainage of the lubricant in the lower gearcase.

A marine drive lower gearcase includes a torpedo housing with an internal cavity holding lubricant for lubricating the gears and bearings in the gearcase. A threaded drain plug is provided in a threaded bore through the torpedo housing near the nose thereof. The bore typically includes a counterbore to accommodate the enlarged head of a threaded member. The outer lip of the counterbore at the nose of the torpedo housing is on the exterior hydrodynamic surface of the torpedo shape along which water flows. The outer lip of the bore is a disruption in the hydrodynamic surface and causes cavitation burns on the torpedo housing and the propeller, i.e. blistered and removed paint on the torpedo housing exterior surface just aft of the plug hole bore, and pitting of the propeller. A further objection to the noted drain plug hole is the difficulty in machining same because it is difficult to hold a location on the eliptical surface of the torpedo.

The present invention addresses and solves the above noted problems in a simple, cost effective manner. In the present invention, the drain plug is mounted to the torpedo housing at a location away from the hydrodynamic surface of the latter to prevent cavitation burns on the torpedo housing and the propeller. The invention also aids in eliminating propeller ventilation.

Brief Description of the Drawings

Prior Art

Present Invention

Figure 2:
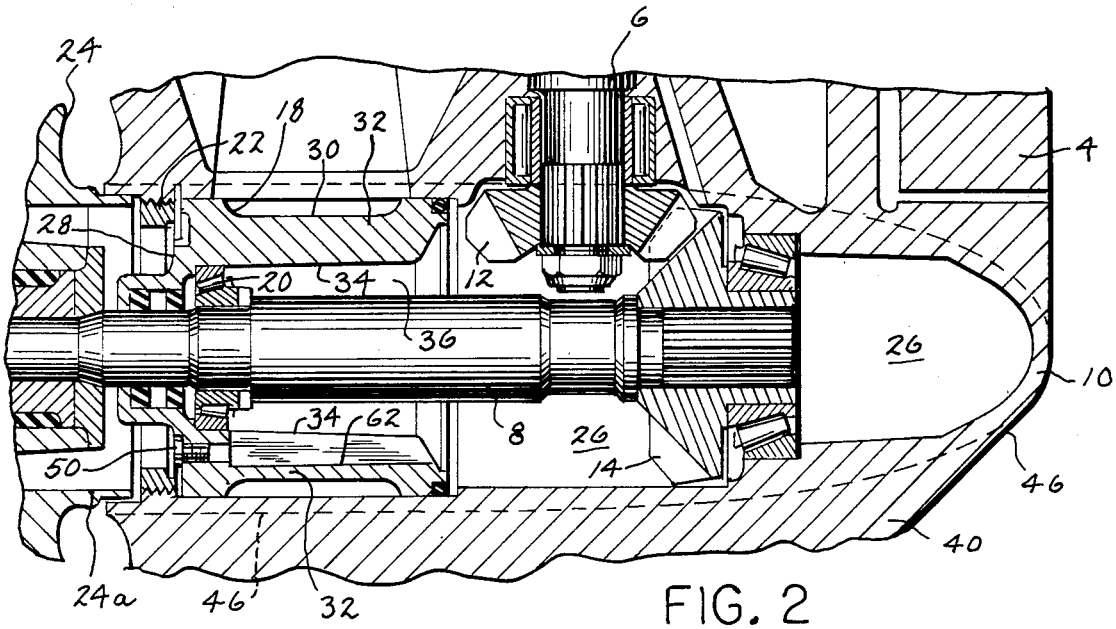

FIG. 2 is a sectional view of a marine drive lower gearcase and torpedo housing with drain plug location in accordance with the invention.

Figure 3:
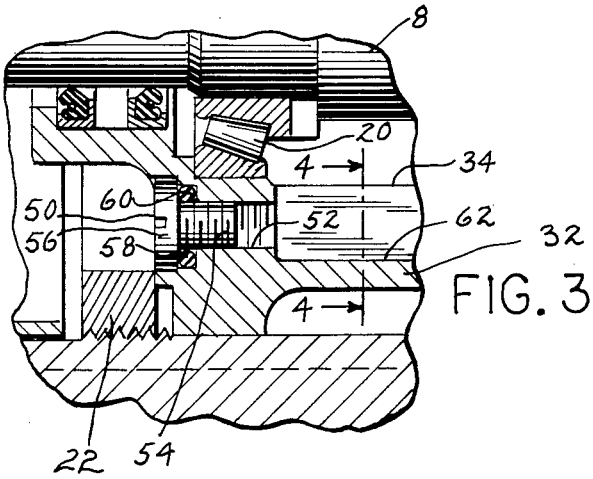

FIG. 3 is an enlarged view of a portion of FIG. 2.

Figure 4:
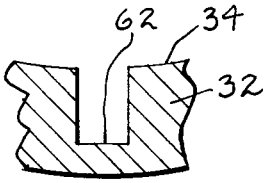

FIG. 4 is a sectional view taken along line 4—4 of FIG. 3.

DESCRIPTION OF PRIOR ART

Figure 1:
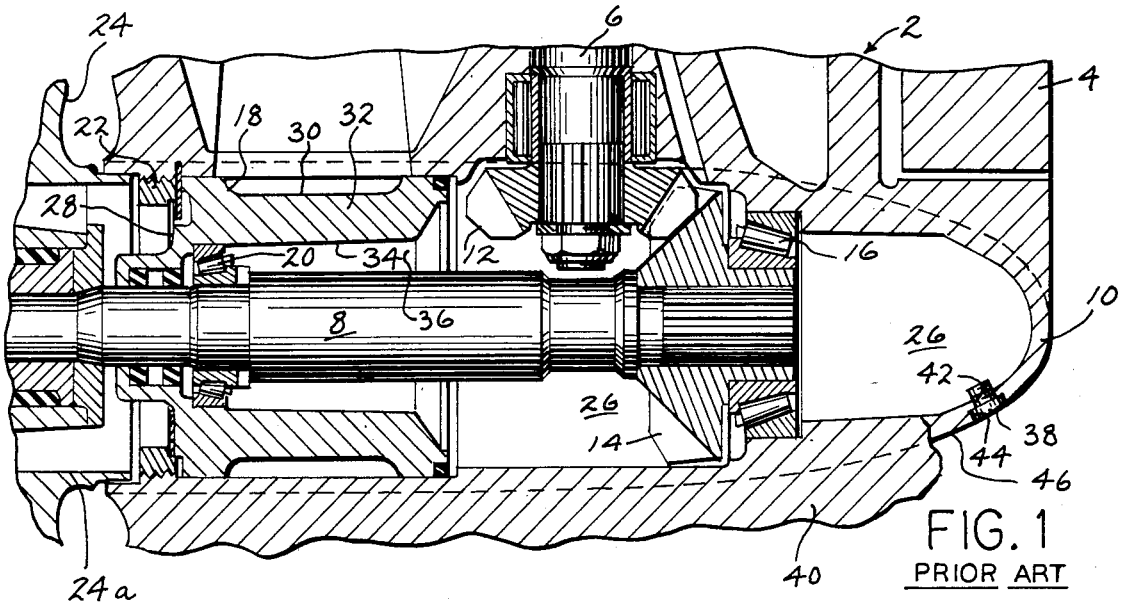
FIG. 1 PRIOR ART
FIG. 1 is a sectional view of a portion of a marine drive lower gearcase and torpedo housing with an internal lubricant containing cavity and drain plug location known in the prior art.

FIG. 1 shows a marine drive 2 having a lower gearcase 4 with a vertical drive shaft 6 driven by an internal combustion engine (not shown) and driving a horizontal propeller shaft 8 in a torpedo housing 10. Beveled pinion gear 12, splined to the bottom of drive shaft 6, drives driven gear 14, which is splined to propeller shaft 8. Propeller shaft 8 is supported for rotation at its front end by tapered roller bearings 16, and is supported for rotation near its rear end by spool 18 and roller bearings 20. Spool 18 is mounted to the rear of the torpedo housing and retained within the torpedo housing by spool nut 22. Propeller 24 is mounted on propeller shaft 8 at the rear of the torpedo housing. Torpedo housing 10 has an internal cavity 26 holding lubricant for lubricating the gears and bearings. Spool 18 has a rear portion 28 facing propeller 24 rearwardly thereof and supporting propeller shaft 8 for rotation at tapered roller bearings 20. Spool 18 has a forward portion 30 extending forwardly into cavity 26. The spool includes an annular side wall 32 having an inner surface 34 spaced outwardly from propeller shaft 8 by an annular gap 36. Annular gap 36 is part of and communicates with internal cavity 26 to thus provide lubricant to tapered roller bearings 20.

A removable threaded drain plug 38 is provided through the torpedo housing near the nose thereof and slightly offset to the side of lower skeg 40. Drain plug 38 is received in threaded bore 42, and the enlarged head of drain plug 38 is received in counterbore 44. Plug 38 is removed by unscrewing it from the bore. The hole through the torpedo housing sidewall disrupts the exterior hydrodynamic surface 46 of the torpedo housing along which water flows. This in turn causes cavitation burns on the torpedo housing immediately downstream of the drain plug hole, and also on the propeller. This also contributes to propeller ventilation.

DESCRIPTION OF THE INVENTION

FIGS. 2-4 show a marine drive lower gearcase and drain plug location in accordance with the invention, and like reference numerals are used from FIG. 1 where appropriate to facilitate clarity. Removable drain plug 50 is provided in the torpedo housing at the rear thereof for draining lubricant upon removal of the plug. The drain plug is mounted at a location away from the exterior hydrodynamic surface of the torpedo housing to prevent cavitation burns on the torpedo housing and the propeller otherwise caused by mounting the drain plug at the hydrodynamic surface as in FIG. 1. The rear portion 28 of spool 18 has a threaded bore 52, FIG. 3, extending forwardly therethrough. Drain plug 50 has a threaded shank portion 54 threaded into bore 52, and an enlarged head portion 56 bearing against 0-ring seal 58 in counterbore 60. Inner surface 34 of annular side wall 32 of spool 18 has a groove 62, FIG. 4, therein axially aligned with bore 52. Drain plug 50 is removed rearwardly by unscrewing it from bore 52, permitting drainage of lubricant from cavity 26 through annular gap 36 and along groove 62 and out through bore 52.

Water flows rearwardly along the outer perimeter hydrodynamic surface 46 of the torpedo housing. Drain plug 50 is mounted at the rear of the torpedo housing and extends forwardly thereinto. The drain plug and its mounting bore are spaced laterally inwardly of exterior outer perimeter hydrodynamic surface 46 of the torpedo housing, to prevent cavitation burns on the torpedo housing and the propeller, and to aid in eliminating propeller ventilation. Drain plug 50 is laterally between propeller shaft 8 and outer perimeter hydrodynamic surface 46, and is forward of propeller 24.

Drain plug 50 is accessed from the rear. Propeller 24 has a hub 24*a* with an outer perimeter having a laterally outward extent beyond drain plug 50 to cover the latter. In one embodiment, propeller 24 is removed from propeller shaft 8 to provide access to drain plug 50. In another embodiment with a propeller having a hub with through-hub exhaust passages extending rearwardly therethrough in an annulus around the propeller shaft, for example as shown in U.S. Pat. Nos. 4,178,873 and 3,871,324, incorporated herein by reference, drain plug 50 is accessed through one of the exhaust passages. In this latter embodiment, head 56 of drain plug 50 may have to be laterally reduced in size in order to provide clearance through the exhaust passage through the propeller hub.

It is recognized that various equivalents, alternatives and modification are possible within the scope of the appended claims.

I claim

1. A marine drive comprising a lower gearcase with a vertical drive shaft driving a horizontal propeller shaft in a torpedo housing and having a propeller mounted on said propeller shaft at the rear of said torpedo housing, said torpedo housing having an internal cavity holding lubricant, said torpedo housing having an exterior hydrodynamic surface along which water flows, a removable drain plug mounted to said torpedo housing at a location away ,from said hydrodynamic surface to prevent cavitation burns on said torpedo housing and said propeller otherwise caused by mounting said drain plug at said hydrodynamic surface, removal of said drain plug permitting draining of said lubricant.

2. The invention according to claim 1 wherein said drain plug extends forwardly into a threaded bore from the rear of said torpedo housing, said bore and said drain plug being spaced laterally inwardly from said exterior hydrodynamic surface of said torpedo housing to prevent said cavitation burns and aid in eliminating propeller ventilation.

3. A marine drive comprising a lower gearcase with a vertical drive shaft driving a horizontal propeller shaft in a torpedo housing and having a propeller mounted on said propeller shaft at the rear of said torpedo housing, said torpedo housing having an internal cavity holding lubricant, a removable drain plug in said torpedo housing at the rear thereof for draining said lubricant upon removal of said plug.

4. The invention according to claim 3 wherein said drain plug is mounted at the rear of said torpedo housing and extends forwardly thereinto.

5. The invention according to claim 4 wherein said housing has an outer perimeter hydrodynamic surface along which water flows rearwardly, and wherein said drain plug is spaced laterally inwardly of said outer perimeter hydrodynamic surface.

6. The invention according to claim 5 wherein said drain plug is mounted at the rear of said torpedo housing between said propeller shaft and said outer perimeter surface, and forward of said propeller.

7. The invention according to claim 6 wherein said propeller has a hub with an outer perimeter having a laterally outward extent beyond said drain plug to cover the latter, and wherein said propeller is removed from said propeller shaft to provide access to said drain plug.

8. The invention according to claim 6 wherein said propeller has a hub with an outer perimeter having a laterally outward extent beyond said drain plug to cover the latter, and wherein said propeller hub has a plurality of exhaust passages extending rearwardly therethrough generally in an annulus around said propeller shaft, and wherein said drain plug is accessed through one of said exhaust passages.

9. A marine drive comprising a lower gearcase with a vertical drive shaft driving a horizontal propeller shaft in a torpedo housing and having a propeller mounted on said propeller shaft at the rear of said torpedo housing, said torpedo housing having an internal cavity holding lubricant, a spool mounted to the rear of said torpedo housing and disposed in said cavity and supporting said propeller shaft for rotation, a removable drain plug in said spool at the rear thereof communicating with said cavity, for draining lubricant from said cavity upon removal of said plug.

10. The invention according to claim 9 wherein said spool has a rear portion facing said propeller rearwardly thereof and supporting said propeller shaft for rotation, and has a forward portion extending forwardly into said cavity in said torpedo housing, and wherein said drain plug extends forwardly through said rear portion of said spool and is accessed from the rear.

11. The invention according to claim 10 wherein said forward portion of said spool comprises an annular side wall having an inner surface spaced outwardly from said propeller shaft by an annular gap, and comprising a groove in said inner surface axially aligned with a bore through said rear portion of said spool receiving said drain plug, such that lubricant drains from said cavity through said annular gap and along said groove and out through said bore upon removal of said drain plug.

* * * * *